US007338588B2

(12) United States Patent
Fray et al.

(10) Patent No.: US 7,338,588 B2
(45) Date of Patent: Mar. 4, 2008

(54) INTERMETALLIC COMPOUNDS

(75) Inventors: Derek John Fray, Cambridge (GB); Robert Charles Copcutt, Cambridge (GB); George Zheng Chen, Cambridge (GB)

(73) Assignee: Cambridge Enterprise Limited (GB)

( * ) Notice: Subject to any disclaimer, the term of this patent is extended or adjusted under 35 U.S.C. 154(b) by 235 days.

(21) Appl. No.: 10/416,909

(22) PCT Filed: Nov. 15, 2001

(86) PCT No.: PCT/GB01/05034

§ 371 (c)(1),
(2), (4) Date: Sep. 29, 2003

(87) PCT Pub. No.: WO02/40748

PCT Pub. Date: May 23, 2002

(65) Prior Publication Data

US 2004/0104125 A1 Jun. 3, 2004

(30) Foreign Application Priority Data

Nov. 15, 2000 (GB) ..... 0027930.7

(51) Int. Cl.
*C25B 1/00* (2006.01)

(52) U.S. Cl. ..... 205/358; 205/357; 205/360

(58) Field of Classification Search ..... None
See application file for complete search history.

(56) References Cited

U.S. PATENT DOCUMENTS 4,239,819 A * 12/1980 Holzl ..... 427/255.39
5,135,782 A * 8/1992 Rostoker et al. ..... 427/435
5,211,775 A 5/1993 Fisher et al.
5,310,476 A * 5/1994 Sekhar et al. ..... 205/230
5,595,612 A * 1/1997 Dingremont ..... 148/318
6,117,208 A 9/2000 Sharma
6,712,952 B1 * 3/2004 Fray et al. ..... 205/640
2004/0159559 A1 * 8/2004 Fray et al. ..... 205/705

FOREIGN PATENT DOCUMENTS

GB 13759 6/1904
GB 626636 A 7/1949
GB 635267 A 4/1950

(Continued)

OTHER PUBLICATIONS

Hirota, K. et al. "Electrochemical Deoxidation of of RE-O (RE=Gd, Tb, Dy, Er) Solid Solutions", *Journal of Alloys and Compounds*, Jan. 15, 1999, pp. 101-108, vol. 282, No. 1-2.

(Continued)

*Primary Examiner*—Harry D Wilkins, III
(74) *Attorney, Agent, or Firm*—Saliwanchik, Lloyd & Saliwanchik

(57) ABSTRACT

A method for the production of an intermetallic compound ($M^1Z$) involves treating a solid precursor material comprising three or more species, including first and second metal or metalloid species ($M^1$, Z) and a non-metal species (X), by electro-deoxidation in contact with a melt comprising a fused salt ($M^2Y$) under conditions whereby the non-metal species dissolves in the melt. The first and second metal or metalloid species form an intermetallic compound. The method is performed in a cell comprising a cathode of the precursor material (2), which is immersed in a melt (8) contained in a crucible (6) for electro-deoxidation.

22 Claims, 2 Drawing Sheets

FOREIGN PATENT DOCUMENTS

| | | |
|---|---|---|
| JP | 11142585 | 5/1999 |
| WO | WO 99/64638 A | 12/1999 |
| WO | WO 01/62995 A | 8/2001 |
| WO | WO 01/62996 A1 | 8/2001 |

OTHER PUBLICATIONS

Okabe, T. H. et al. "Electrochemical Deoxidation of Yttrium-Oxygen Solid Solutions", *Journal of Alloys and Compounds*, Apr. 15, 1996, pp. 150-154, vol. 237.

Okabe, T. H. et al. "Electrochemical Deoxidation of Titanium", Metallurgical Transactions B., Jun. 1993, pp. 449-455, vol. 24B.

Chen, G.Z. et al. "Direct electrochemical reduction of titanium dioxide to titanium in molten calcium chloride" *Nature*, Sep. 21, 2000, pp. 361-364, vol. 407.

Chen, G. Z. et al. "Novel Direct Electrochemical Reduction of Solid Metal Oxides to Metals using Molten Calcium Chloride as the Electrolyte" *Special Proceedings Volume, Molten Salt Forum vol. 7, Progress in Molten Salt Chemistry vol. 1*, Aug. 20-25, 2000, pp. 157-161, eds. R. W. Berg and H.A. Hjuler, Elsevier 2000.

Ferro, P. D. et al. "Application of Ceramic Membrane in Molten Salt Electrolysis of $CaO-CaCl_2$" *Waste Management*, 1997, pp. 451-461, vol. 17, No. 7.

Okabe, T. H. et al. "Thermodynamic Properties of Ln-O (Ln=La, Pr, Nd) Solid Solutions and Their Deoxidation by Molten Salt Electrolysis" *Shigen-Lo-Sozai*, 1998, pp. 813-818, vol. 114.

Okabe, T. H. et al. "Production of niobium powder by electronically mediated reaction (EMR) using calcium as a reductant" *Journal of Alloys and Compounds*, 1999, pp. 200-210, vol. 288.

Okabe, T. H. et al. "Preparation and characterization of extra-low-oxygen titanium" *Journal of Alloys and Compounds*, 1992, pp. 43-56, vol. 184.

Okabe, T. H. et al. "Deoxidation of Titanium Aluminide by Ca-Al Alloy under Controlled Aluminum Activity" *Metallurgical Transactions B*, Oct. 1992, pp. 583-590, vol. 23B, No. 5.

Oki, T. et al. "Reduction of Titanium Dioxide by Calcium in Hot Cathode Spot" *Department of Metallurgical Engineering*, May 31, 1967, pp. 164-166.

Opie, W. R. et al. "A Basket Cathode Electrolytic Cell for Production of Titanium Metal" *Transactions of the Metallurgical Society of AIME*, Aug. 1960, pp. 646-649, vol. 218.

Swinkels, D. A. J. "Thermal Batteries" In *Advances in Molten Salt Chemistry 1*, ed. J. Braustein et al., 1971, pp. 188-191, Plenum Press.

Ward, R. G. et al. "The Electrolytic Removal of Oxygen, Sulphur, Selenium, and Tellurium from Molten Copper" *Journal of the Institute of Metals*, 1961-1962, pp. 6-12, vol. 90.

"Extra-low oxygen titanium@ prodn.—by heating mixt. of titanium@ raw material and high purity flux, removing flux with acid and discharging, for structural part" 1992, XP-002244274, abstract only.

Mishra, B. et al. "Diffusion Coefficient of Oxygen Ions in Molten Calcium Chloride" 9th Symposium on Molten Salts, *Electrochem. Soc.*, 1994, pp. 697-704.

Mishra, B. et al. "Application of Molten Salts in Pyrochemical Processing of Reactive Metals" *Moltens Salts*, Electrochem. Soc., 1992, pp. 184-203, vol. 92-16, ed. R. J. Gale et al.

* cited by examiner

INTERMETALLIC COMPOUNDS

This application is a National Stage Application of International Application Number PCT/GB01/05034, published, pursuant to PCT Article 21 (2).

FIELD OF THE INVENTION

This invention relates to a method and an apparatus for preparing intermetallic compounds, and to intermetallic compounds so produced.

BACKGROUND TO THE INVENTION

Intermetallic compounds are compounds of a defined structure comprising a metal and either a non-metal (metalloid) or further metal, They have many applications. For example silicon carbide is used in metal matrix composites as a strengthening additive and for furnace electrodes. Molybdenum silicide is also used as a furnace element and as a strengthening agent. Titanium diboride is used as a possible cathode material for the Hall-Heroult cell for the extraction of alumina.

Carbides are amongst the most refractory materials known. Many carbides have softening points above 3000° C. and the more refractory carbides possess some of the highest melting points ever measured. Of the simple carbides, the most refractory are HfC and TaC, which melt at 3887° C. and 3877° C. The complex carbides 4TaC.ZrC and 4TaC.HfC melt at 3932° C. and 3942° C., respectively. Silicon carbide is quite resistant to oxidation at temperatures up to about 1500° C. and has useful oxidation resistance for many purposes at temperatures up to 1600° C. It is used extensively for example as an abrasive, as a refractory and as a resistor element for electric furnaces.

Most carbides have fair thermal and electrical conductivity, and many of them are quite hard, boron carbide being the hardest. High hardness accounts for the usefulness of many of the carbides, such as silicon carbide, titanium carbide, boron carbide and tungsten carbide as materials for cutting, grinding and polishing and for parts subject to severe abrasion or wear.

Most carbides are prepared by the reaction of the oxide with carbon at elevated temperatures. Other methods of preparation include vapour deposition from the gaseous phase.

The carbides of Group II elements are usually prepared commercially by reacting the oxide with graphite in an electric-arc furnace at around 2000° C. Boron carbide and silicon carbide are made by a similar route, as are transition or hard metal carbides. High purity carbides are difficult to prepare commercially.

$TiB_2$ and $ZrB_2$ have potential for replacing carbon as an electrode material in aggressive electrochemical applications such as aluminium refining. Their good electrical conductivity, good wettability and excellent chemical resistance means greatly increased lifetimes. $TiB_2$ is harder than tungsten carbide and has an excellent stiffness to weight ratio so it has important applications for cutting tools, crucibles and other corrosion resistance applications.

Boride powders can be prepared by the carbothermic or aluminothermic reduction of metal oxide-boron oxide mixtures, by electrolysis of fused salt mixtures containing metal oxides and boron oxide and by heating mixtures of metal and boron powders to high temperatures in an inert atmosphere. Fusion electrolysis is especially suited to the large-scale production of boride powders of relatively high purity from naturally occurring raw materials, and does not require the initial preparation of metal and boron powders. However, the current efficiency is very low of the order of 5%.

Of conventional methods, direct synthesis of refractory borides permits the greatest control of composition and purity of the resulting boride. However, the temperature required is very high (1700° C.).

Conventionally, silicides can be prepared by six general methods, i.e. synthesis from the elements (metal and silicon); reaction of metal oxide with silicon; reaction of metal oxide with silicon and carbon; and reaction of silica and metal oxide with carbon, aluminium or magnesium. The silicides are chemically inert, have high thermal and electrical conductivities, are hard and have high strengths at elevated temperatures coupled with high melting points.

Aluminides are made by the direct reaction of the elements.

Generally, these interesting materials are made at very high temperatures where it is difficult to ensure high purity. The electrochemical methods that have been tried generally work at very low current efficiencies.

SUMMARY OF THE INVENTION

The invention provides a method and an apparatus for making intermetallic compounds, and the intermetallic compounds so produced, as defined in the appended independent claims. Preferred or advantageous features of the invention are set out in dependent subclaims.

The present invention is based on the surprising finding that intermetallic compounds can be made using a simple electrochemical process. Thus, the invention may advantageously provide a method for the production of an intermetallic compound ($M^1Z$) which involves treating a solid precursor material comprising three or more species, each species being for example an element or an ion, or other component of a compound such as a covalent compound. The three or more species include first and second metal or metalloid species ($M^1$,Z) and an anionic or non-metal species (X), and the precursor material is treated by electrodeoxidation in contact with a melt comprising a fused salt ($M^2Y$) under conditions whereby the anionic or non-metal species dissolves in the melt. The first and second metal or metalloid species then form an intermetallic compound. More complex intermetallic compounds comprising three or more metal or metalloid species may similarly be formed. In the precursor material, the metal or metalloid species may advantageously be present in the appropriate ratios to form a stoichiometric intermetallic with minimum wastage.

In one embodiment, the precursor material may consist of a single compound. For example, if the precursor material is formed of titanium borate powder, then the first and second metals or metalloids, Ti and B, can form $TiB_2$ when the anionic or non-metal species, $O^{2-}$, is removed by electrodeoxidation. Corresponding results may be achieved by using precursor materials comprising other ions such as $CO_3$, $SO_4$, $NO_2$ or $NO_3$ in which both a metal or metalloid species and an anionic or non-metal species are present.

In an alternative embodiment the precursor material may comprise a compound such as those described above mixed with a further substance, such as a further compound or an element or a more complex mixture, which may advantageously enable the formation of more complex intermetallics.

In another embodiment, the precursor material may be a mixture of a first solid compound ($M^1X$) between the first metal or metalloid ($M^1$) and the anionic or non-metal species (X), and a solid substance (S) which consists or comprises the second metal or metalloid (Z). In this case, the substance (S) may be an element (i.e. the metal or metalloid (Z) itself) or an alloy, or it may be a second compound comprising the second metal or metalloid (Z) and a second anionic or non-metal species. Advantageously, the second non-metal species may then be the same as the non-metal species (X) in the first compound ($M^1X$).

The term electro-deoxidation is used herein to describe the process of removing the anionic or non-metal species (X) from a compound in the solid state by contacting the compound with the melt and applying a cathodic voltage to the compound(s) such that the non-metal species dissolves or moves through the melt to the anode. In electrochemistry, the term oxidation implies a change in oxidation state and not necessarily a reaction with oxygen. It should not, however, be inferred that electro-deoxidation always involves a change in the oxidation states of the components of the compound; this is believed to depend on the nature of the compound, such as whether it is primarily ionic or covalent. In addition, it should not be inferred that electro-deoxidation can only be applied to an oxide; any compound may be processed in this way.

In a preferred embodiment, the cathodic voltage applied to the metal compound is less than the voltage for deposition of cations from the fused salt at the cathode surface. This may advantageously reduce contamination of the intermetallic compound by the cations. It is believed that this may be achieved under the conditions of an embodiment providing a method for the production of an intermetallic compound ($M^1Z$) comprising treating a mixture of a metal compound ($M^1X$) and a substance (Z) by electrolysis, or electro-deoxidation, in a fused salt ($M^2Y$), under conditions whereby reaction of X rather than $M^2$ deposition occurs at an electrode surface, and X dissolves in the electrolyte $M^2Y$, or moves through the melt to the anode. In various instances, the process of electro-deoxidation may alternatively be termed electro-decomposition, electro-reduction or solid-state electrolysis.

Further details of the electro-deoxidation process are set out in International patent application number PCT/GB99/01781, which is incorporated herein by reference in its entirety.

The precursor material is advantageously formed by powder processing techniques, such as compaction, slip-casting, firing or sintering, from its constituent material or materials in powder form. Preferably the precursor material so formed is porous, to enhance contact with the melt during electro-deoxidation. The precursor material may alternatively be used in the form of a powder, suitably supported or positioned in the melt.

Advantageously, if the precursor material is a conductor it may be used as the cathode. If C or B powder is incorporated to form carbides or borides, this will generally increase the conductivity of the mixture. Alternatively, the precursor material may be an insulator and may then be used in contact with a conductor.

In the method of invention, it is preferable for the intermetallic compound produced to have a higher melting point than that of the melt.

The method of the invention may advantageously give a product which is of very uniform particle size and free of oxygen or other non-metal species from the precursor material.

A preferred embodiment of the present invention is based on the electrochemical reduction of an oxide powder in combination with a further metal, non-metal (metalloid) or compound (which may be in the oxide form), by cathodically ionising the oxygen away from the oxide so that the reduced substances combine together to form intermetallic compounds. Thus, in a preferred embodiment, the method for making the intermetallic compounds relies on making a mixture of oxide powders the cathode in a melt comprising a fused salt, such that the ionisation of oxygen takes place preferentially rather than the deposition of cations from the salt, and that the oxygen ions are mobile in the melt.

SPECIFIC EMBODIMENTS AND BEST MODE OF THE INVENTION

Embodiments of the invention will now be described by way of example, with reference to the accompanying drawings, in which.

Figure 1:
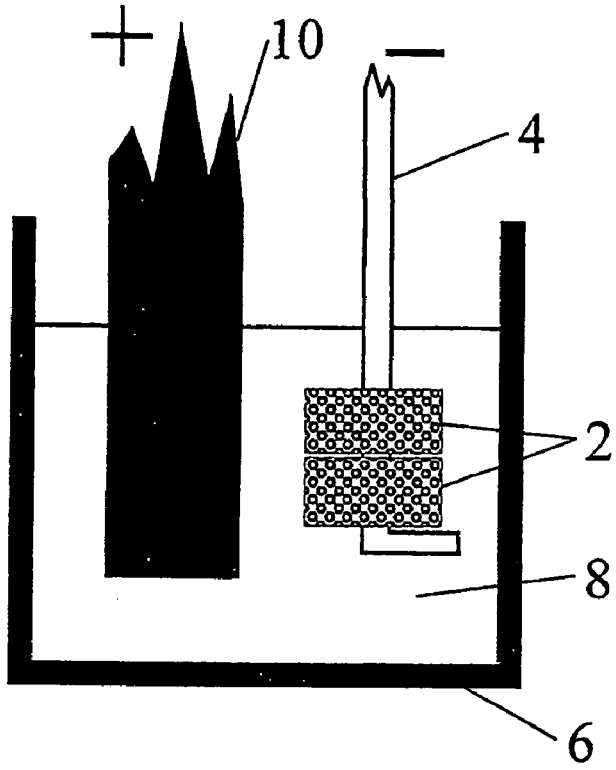
FIG. 1 illustrates an apparatus according to a first embodiment of the invention.

FIG. 1 shows two pellets 2 of a precursor material, which in this case is a mixture of metal oxides, in contact with a cathode conductor 4, such as a Kanthal wire. Each pellet is prepared by pressing or slip-casting micrometre-sized powders (for example up to about 25 μm or 100 μm, or between about 0.2 and 2 μm particle size) and then, usually, firing or sintering. This produces a porous pellet, which advantageously allows intimate contact between the precursor material and the melt during electro-deoxidation. The pellet is then made the cathode in a cell comprising an inert crucible 6, such as an alumina or graphite crucible, containing a fused salt 8. On the application of current (making the pellets the cathode), the oxygen in the metal oxides ionises and dissolves in the salt, and diffuses to a graphite anode 10, where it is discharged. Effectively the oxygen is removed from the oxides, leaving the metals behind.

The electrolyte, or melt, 8 consists of a salt or salts which are preferably more stable than the equivalent salts of the individual elements of the intermetallic compound which is being produced. More preferably, the salt should be as stable as possible to remove the oxygen to as low a concentration as possible. The choice includes the chloride, fluoride or sulphate salts of barium, calcium, cesium, lithium, strontium and yttrium or even Mg, Na, K, Yb, Pr, Nd, La and Ce.

To obtain a salt with a lower melting point than that given by a pure salt, a mixture of salts can be used, preferably the eutectic composition. In the embodiment, the cell contains chloride salts, being either $CaCl_2$ or $BaCl_2$ or their eutectic mixture with each other or with another chloride salt such as NaCl.

At the end of reduction, or electro-deoxidation, the reduced compact, or pellet, is withdrawn together with the salt contained within it. The pellet is porous and the salt contained within its pores advantageously stops it from oxidising. Normally, the salt can simply be removed by washing in water. Some more reactive products may need to be cooled first in air or in an inert atmosphere and a solvent other than water may be required. Generally, the pellets are very brittle and can easily be crushed to intermetallic powder.

Figure 2:
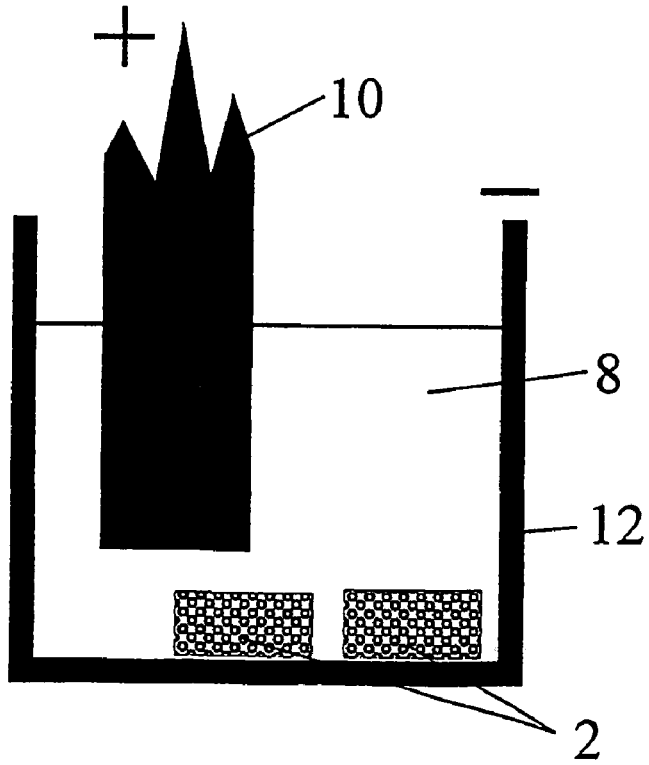
FIG. 2 illustrates an apparatus according to a second embodiment of the invention.

FIG. 2 shows an apparatus similar to that of FIG. 1 (using the same reference numbers where appropriate) but using a conductive crucible 12 of graphite or titanium. The pellets sink in the melt and contact the crucible, to which the cathodic voltage is applied. The crucible itself thus acts as a current collector.

Figure 3:
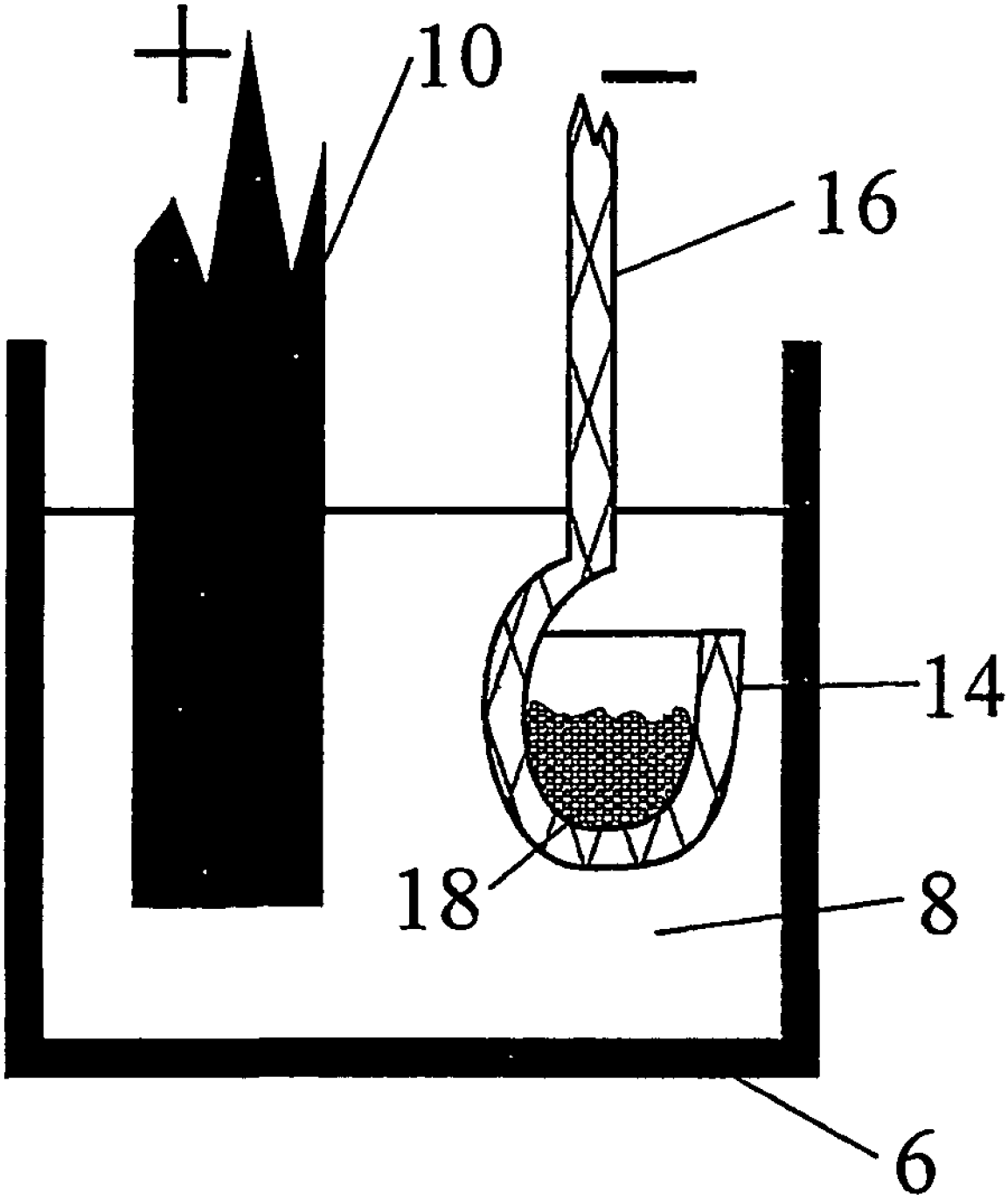
FIG. 3 illustrates an apparatus according to a third embodiment of the invention.

FIG. 3 shows an apparatus similar to that of FIGS. 1 and 2 (using the same reference numbers where appropriate) but in which the precursor material is supported in a smaller crucible 14 which can be lowered and raised into and out of the melt, suspended on a wire 16 which also allows electrical connection so that the smaller crucible, which is electrically conducting, can act as a cathodic current collector. This apparatus may advantageously be more flexible than that of FIG. 1 or 2 in that it may be used for electro-deoxidation not only of pellets or the like but also of loose powders or other forms of precursor material 18.

In a further embodiment, the smaller crucible may be inverted to allow treatment of precursor materials less dense than the melt. An inverted smaller crucible may be covered by a grid to retain materials on immersion into and removal from the melt. The smaller crucible may even be closed, apart from apertures to allow access by the melt, for better retention of the precursor material and the reaction product.

The following Examples illustrate the invention.

EXAMPLE 1

A pellet, 5 mm in diameter and 1 mm in thickness was formed from a mixture of $SiO_2$ and C powders, and placed in a carbon crucible filled with molten calcium chloride at 950° C. A potential of 3 V was applied between a graphite anode and the graphite crucible (as in FIG. 2). After 5 hours, the pellet was removed from the crucible, the salt allowed to solidify and then dissolved in water to reveal the intermetallic compound.

The cathodic reaction is $SiO_2+C+4e=SiC+2O^{2-}$

EXAMPLE 2

A pellet, 5 mm in diameter and 1 mm in thickness, of titanium dioxide powder and boron powder or, in a separate test, a pellet formed of titanium borate powder was placed in a crucible containing molten barium chloride at 950° C. A potential of 3 V was applied between a graphite anode and the crucible. After 5 hours, the pellet was removed from the crucible, the salt allowed to solidify and then dissolved in water.

The cathodic reaction that had occurred was $$TiO_2+2B+4e=TiB_2+2O^{2-}$$

or $$TiO_2.B_2O_3+10e=TiB_2+5O^{2-}$$

EXAMPLE 3

A pellet, 5 mm in diameter and 1 mm in thickness, of mixed powders of molybdenum oxide and silicon or, in a separate test, molybdenum oxide and silicon dioxide was placed in a graphite crucible filled with molten calcium chloride at 950° C. A potential of 3 V was applied between a graphite anode and the graphite crucible. After 5 hours, the pellet was removed from the crucible, the salt allowed to solidify and then dissolved in water.

The reaction which had taken place was $$MoO_2+2Si+4e=MoSi_2+2O^{2-}$$

or $$MoO_2+2SiO_2+12e=MoSi_2+6O^{2-}$$

EXAMPLE 4

A pellet, 5 mm in diameter and 1 mm in thickness, of mixed powders of alumina and titanium dioxide was placed in a titanium crucible filled with molten calcium chloride at 950° C. A potential of 3 V was applied between a graphite anode and the titanium crucible. After 5 hours, the pellet was removed from the crucible, the salt allowed to solidify and then dissolved in water.

The reaction which had taken place at the cathode was $$Al_2O_3+2TiO_2+14e=2TiAl+7O^{2-}$$

It can be appreciated that, by varying the ratio of the constituents, the ratios of the elements in the intermetallic compound can be varied.

EXAMPLE 5

Molybdenum disilicide. Powders of $MoO_3$ and $SiO_2$ were mixed together, pressed into a pellet and sintered at 600° C. The sintered pellet was put into a steel crucible and lowered into a larger container of molten calcium chloride at 785° C. A voltage of 3.0 V was applied for 24 hours between the pellet and a graphite anode. The crucible was removed from the melt and washed with water. After filtering and drying the powder it was analysed by XRD (X-ray diffraction) which revealed an abundance of $MoSi_2$ with a smaller quantity of other compounds such as $CaSiO_3$, $CaCO_3$ and SiC.

EXAMPLE 6

The above experiment was repeated with a $MoO_3/SiO_2$ mixture sintered at 650° C. After reducing the pellet for 24 hours at 3.0 V the crucible containing the pellet was washed with distilled water and then with 0.1 M hydrochloric acid. XRD of the remaining powder again confirmed the production of $MoSi_2$ but $CaSiO_3$ and SiC remained as minor constituents.

EXAMPLE 7

Titanium carbide. $TiO_2$ and graphite powders were mixed and pressed into pellets which were sintered for 1 hour at 1200° C. in a vacuum furnace. These pellets were placed in a small alloy steel crucible which was then immersed in calcium chloride at 800° C. for 43 hours using 3.0 V. When the small crucible was removed from the melt and washed in water a black powder remained. EDX (energy-dispersive X-ray analysis) and XRD analysis of the filtered and dried fine powder confirmed the production of TiC.

EXAMPLE 8

Zirconium carbide. $ZrO_2$ and graphite powders were mixed and pressed into pellets. The pellets were sintered at 1200° C. for 1 hour in a vacuum furnace. The pellets were reduced in molten calcium chloride at 800° C. for 43 hours using 3.0 V. After washing in water for 2 days, filtering and drying, the remaining powder and lumps were ground and analysed by XRD. ZrC was clearly the dominant compound with a little $CaZrO_3$ and carbon also present. EDX confirmed that Zr and C were the dominant elements.

EXAMPLE 9

Tantalum carbide. $Ta_2O_5$ and graphite powders were mixed and pressed into pellets and sintered in a vacuum furnace at 1200° C. for 1 hour. The pellets were then reduced in calcium chloride at 800° C. using 3.0 V for 25 hours. XRD analysis of the powder confirmed TaC with a very small amount of Ta also present. EDX analysis confirmed the high purity of the product.

EXAMPLE 10

Titanium diboride. $TiO_2$ and boron powders were mixed and pressed into pellets which were sintered for 1 hour at 1200° C. in a vacuum furnace. These pellets were then reduced for 24 hours at 800° C. using 3.0 V. EDX and XRD analysis of the resulting fine powder confirmed the production of $TiB_2$.

EXAMPLE 11

Zirconium diboride. $ZrO_2$ (yttria stabilised) and boron powders were mixed and pressed into pellets before sintering at 1200° C. for 1 hour in a vacuum furnace. The pellets were then reduced in a calcium chloride melt at 800° C. using 3.0 V for 25 hours. XRD of the resulting powder and lumps revealed $ZrB_2$ and $Y_2O_3$ with no other compound being detected. The high purity of the product and the fact that the yttria remained unreduced while the zirconia was completely converted to the boride is a significant result. EDX analysis indicated about 2% calcium which was not apparent on the XRD result.

EXAMPLE 12

Chrome silicon. $SiO_2$ and $Cr_2O_3$ powders were mixed and formed into pellets which were sintered in air. The pellets were reduced in a molten mixture consisting of about 85% sodium chloride and 15% calcium chloride at 800° C. for 20 hours using 3.0 V. After washing in water and drying, the resulting lumps were ground and analysed by XRD. $Cr_3Si$, $Cr_5Si_3$, $CaCO_3$, $CrSi_2$, $CrSiO_4$, and $CaSiO_3$ were all present in order of decreasing abundance. EDX showed grains about 2 μm diameter containing mainly Si, Cr, Ca and O.

EXAMPLE 13

Silicon titanium. $SiO_2$ and $TiO_2$ powders were mixed and formed into pellets which were sintered in air. The pellets were reduced in a molten mixture consisting of about 85% sodium chloride and 15% calcium chloride at 800° C. for 19 hours using 3.0 V. After washing in water and drying the lumps were ground and analysed by XRD. $Ti_5Si_3$, $Ca_2SiO_4$, $Ti_5Si_4$, TiSi and Si were all present in order of decreasing abundance. EDX showed a porous matrix containing mainly Si, Ti, Ca and O.

Further Aspects and Embodiments

The need to fire the metal oxide/graphite pellets in a vacuum furnace in a number of the embodiments described above adds cost to the process. Although the temperatures required are advantageously much lower than when using the conventional direct synthesis route to, for example, carbide production, an alternative system could be of benefit. If one of the more stable carbonates such as $K_2CO_3$ or $Na_2CO_3$ was mixed into the precursor material the carbonate would be decomposed during electrolysis and some of the carbon would react with the other cations in the precursor to form carbides. Sodium and potassium do not form stable carbides so they would come out of the reactor as the metal itself, which could be removed with alcohol.

Boron-metal oxide mixed pellets may be sintered in air because a very thin protective boron oxide layer forms and prevents further oxidation. However, the use of elemental boron has the disadvantage that it is not the cheapest source of boron. Boron occurs naturally as boron oxide, sodium borate, and calcium borate. Boron oxide is a glass and softens above 500° C. which means that unless it reacts in some way with the metal oxides or other compounds also making up the pellet it may be difficult to hold the pellet in or on the cathode. Boron oxide is also typically less dense than the electrolyte so it will tend to float while most metal oxides will tend to sink. The boron oxide may also, because of softening at elevated temperatures, form a non-porous pellet which would slow the electro-deoxidation. The electrolyte temperature could be reduced to below 450° C. by using a mixture of halide salts, but that may add cost and slow the reduction even further.

Sodium borate has a higher melting point than boron oxide so it is easier to use to make a mixed pellet. Reduction of the pellet may then advantageously form the desired boride and sodium metal. The sodium metal could be easily and safely removed from the reduced pellet by immersing it in methanol or ethanol. Calcium borate has even more advantages than sodium borate because its melting point is even higher and the calcium metal by-product can be removed safely with water.

Silicon very readily combines with calcium to form calcium silicate as shown by all XRD analyses performed on precursor materials which had started with silica in them and were processed in calcium salts. Much of the silicon may disadvantageously be wasted because of this. It has been found, however, that by using a molten electrolyte that contains little or no calcium salts it was possible to reduce this problem considerably. For example, sodium chloride or other sodium salts or salts of other metals such as alkali or alkaline earth metals or yttria may be used.

The invention claimed is:

1. A method for the production of a compound ($M^1Z$) comprising:

providing a solid precursor material comprising three or more species ($M^1$, Z, X) including:

i) a first species ($M^1$) selected from the group consisting of metals, Si, and B;

ii) a second species (Z) selected from the group consisting of C, N, B, and Si; and iii) a non-metal species (X); and treating the solid precursor material by electro-deoxidation in contact with a melt comprising a fused salt ($M^2Y$) under conditions whereby the non-metal species dissolves in the melt to form the compound ($M^1Z$) comprising the first species and the second species.

2. The method according to claim 1, in which the precursor material consists of a single precursor compound.

3. The method according to claim 1, in which the precursor material is a mixture of a first solid precursor compound ($M^1X$) comprising the first species ($M^1$) and the non-metal species (X), and a solid substance (S) which consists of or comprises the second species (Z).

4. The method according to claim 3, in which the substance (S) is a second precursor compound, comprising the second species (Z) and a second non-metal species.

5. The method according to claim 4, in which the second non-metal species is the same as the non-metal species (X) in the first precursor compound ($M^1X$).

6. The method according to claim 3, in which the electrolysis product ($M^2X$) is more stable than the precursor material or the first precursor compound.

7. The method according to claim 3, in which one or both of the first and second precursor compounds is an oxide.

8. The method according to claim 1, in which the precursor material is a conductor and is used as a cathode.

9. The method according to claim 1, in which the precursor material is an insulator and is used in contact with a conductor.

10. The method according to claim 1, in which electrolysis is carried out at a temperature of 700° C.-1000° C.

11. The method according to claim 1, in which the fused salt comprises one or more of the group consisting of Ca, Ba, Li, Cs and Sr.

12. The method according to claim 1, in which the fused salt comprises one or more of the group consisting of Cl, F and $SO_4$.

13. The method according claim 1, in which the non-metal species comprises one or more of the group consisting of O, S, C and N.

14. The method according to claim 1, in which the non-metal species comprises O and/or S.

15. The method according to claim 1, in which the precursor material comprises a precursor compound incorporating one or more of the compounds selected from the group consisting of $CO_3$, $SO_4$, $NO_2$ and $NO_3$.

16. The method according to claim 1, in which the first species comprises Ti, Si, Ge, Zr, Hf, Sm, U, Al, Mg, Nd, Mo, Cr or Nb, or any other lanthanide or any other actinide.

17. The method according to claim 1, in which the electro-deoxidation is carried out under conditions whereby the cathodic voltage applied to the precursor material is less than the voltage for deposition of cations ($M^2$) from the fused salt at the cathode surface or, if the melt comprises a mixture of salts, less than the voltage for deposition of any cation ($M^2$) from the melt at the cathode surface.

18. The method according to claim 1, in which the precursor material comprises one or more first species selected from the group comprising metals and Si.

19. The method according to claim 1, in which the precursor material comprises one or more second species selected from the group consisting of C, N, and B.

20. The method according to claim 1, in which the precursor material comprises one or more non-metal species.

21. The method according to claim 1, in which the second species (Z) is C.

22. The method according to claim 1, in which the second species (Z) is B.

* * * * *